US009615410B2

(12) United States Patent
McRae

(10) Patent No.: US 9,615,410 B2
(45) Date of Patent: Apr. 4, 2017

(54) LIGHTED SOCKETS

(71) Applicant: Michael M McRae, Ormond Beach, FL (US)

(72) Inventor: Michael M McRae, Ormond Beach, FL (US)

(73) Assignee: National Christmas Products, Inc., Cranford, NJ (US)

( * ) Notice: Subject to any disclaimer, the term of this patent is extended or adjusted under 35 U.S.C. 154(b) by 0 days.

(21) Appl. No.: 14/120,726

(22) Filed: Jun. 20, 2014

(65) Prior Publication Data

US 2015/0084511 A1 Mar. 26, 2015

Related U.S. Application Data

(60) Provisional application No. 61/956,965, filed on Jun. 20, 2013.

(51) Int. Cl.
*H01R 13/68* (2011.01)
*H05B 33/08* (2006.01)
*H05B 37/03* (2006.01)

(52) U.S. Cl.
CPC ..... *H05B 33/0803* (2013.01); *H05B 33/0809* (2013.01); *H05B 37/03* (2013.01)

(58) Field of Classification Search
CPC ..... H01R 13/6683
USPC ..... 315/121, 122, 185 R, 129; 439/49, 188, 439/620.02, 488, 490; 362/95, 437, 443, 362/448, 800
See application file for complete search history.

(56) References Cited

U.S. PATENT DOCUMENTS

| | | | | |
|---|---|---|---|---|
| 7,732,942 | B2 * | 6/2010 | Janning | 307/36 |
| 8,138,680 | B2 * | 3/2012 | Pan | 315/185 R |
| 8,680,889 | B2 * | 3/2014 | Leshniak | 326/121 |
| 2002/0195945 | A1 * | 12/2002 | Gershen et al. | 315/55 |

* cited by examiner

*Primary Examiner* — Thuy Vinh Tran
(74) *Attorney, Agent, or Firm* — Brian K. Johnson, Esq., LLC

(57) ABSTRACT

An illuminated light socket is provided for powering a light bulb in a typical light string system. The illuminated socket contains its own lighting element, separate and distinct from the light bulb. The lighting element remains off when the light bulb is inserted into the socket and is illuminating properly. The lighting element illuminates when either the bulb is removed from the socket or the bulb is not illuminating correctly. The illuminated light element provides a visually perceptible warning, on the socket itself, that the associated light bulb is either absent or defective. Alternatively, a collar performing the same function is provided such that the collar may be mounted to existing light sockets. The illuminated sockets and housings may accommodate light bulbs of any technology, e.g. incandescent, LED (single or multiple color), or electroluminescent. The socket lighting element itself is preferably a low power LED or electroluminescent light.

15 Claims, 17 Drawing Sheets

LIGHTED SOCKETS

CROSS REFERENCE TO RELATED APPLICATIONS

This application claims priority to and the benefit of U.S. Provisional Patent Application No. 61/956,965 filed Jun. 20, 2013 titled "LIGHTED SOCKET" the contents of which are incorporated by reference herein in their entirety.

STATEMENT REGARDING FEDERALLY SPONSORED RESEARCH OR DEVELOPMENT

Not applicable.

BACKGROUND OF THE INVENTION

1. Field of the Invention

The invention discloses a lighted socket, or an attachable light socket collar, within a light string system. The socket or collar itself is illuminated when the bulb is removed from the socket or the bulb is otherwise malfunctioning. A separate illumination element is provided either as part of the socket itself or is attached thereto and is coupled to both power circuitry and associated control circuitry within the socket such that when the light bulb is removed or malfunctions, the socket lighting element illuminates and identifies the specific and exact light bulb within the string that requires replacement. In a particularly preferred embodiment, the resistance of the separate illumination element is properly selected to maintain substantially the same voltage across the entire light socket, including the light socket illumination element and defective bulb, such that constant current is maintained in the light string. This condition allows the remaining functional bulbs to all remain on and in a safe operating condition.

2. Description of the Prior Art

U.S. Pat. No. 6,518,707, Issued Feb. 11, 2003 to Gershen et al. (hereinafter "Gershen et al.") discloses a voltage detector for a series light circuit. Gershen et al.'s voltage detector takes the form of a resistor, one each connected in parallel with each lamp within the light string. (FIG. 5.) Each resistor is coated with thermochromatic paint that changes from opaque to clear when sufficient power is applied across the resistor. The failure of a bulb in the light string causes the resistor to consume the majority of the light string's circuit power and dissipate that power as heat. When the thermochromatic paint turns clear due to the heat of the engaged resistor, the original color of the resistor is revealed for identification by the user. (Col. 4, 11. 31-43.) However, Gershen et al. does not disclose how the resistor itself is returned to its original state (i.e. recoated with the thermochromatic paint) once the defective bulb burns out and is replaced. (See FIG. 2 showing the resistor as part of the socket base and not as part of the replaceable bulb.)

In order for Gershen et al. to work, the resistor must be sized sufficiently such that enough heat is generated within the resistor upon bulb failure so as to activate the thermochromatic paint. As disclosed in Gershen et al., this typically results in a resistor value in the tens of kilo-ohms, which necessarily reduces the voltage within the light string to a near zero value. Thus, none of the functioning bulbs on Gershen's LED light string are provided sufficient bias voltage or current to remain illuminated upon bulb failure. The faulty bulb is capable of being located, but the string is inoperative. (Col. 4, 1. 44 to col. 5, 1. 14.)

Gershen et al. also discloses other forms of voltage detectors, such as audible alarms (Col. 5, 1. 35.) and electroluminescent lamps (col. 5, 1. 45 et seq.). Each of these disclosed arrangements have limitations that either prevent the remaining, non-failing bulbs on the light string from remaining lit or do not permit more than a small number of bulb/socket failure detections.

Thus it is an object of this invention, and the failure of the prior art to-date, to deliver a light string in which failed bulbs and/or their associated sockets, using any lighting technology, are clearly identified by visual means and in which the remaining, non-defective bulbs within the light string remain on.

BRIEF SUMMARY OF THE INVENTION

In one particularly preferred embodiment of the invention, a light socket is provided for supplying power to a light bulb, the light socket having two terminals coupled to two light string leads, the light string leads coupled to an electrical power source to provide current to the socket through the two light string leads, the terminals coupled to the bulb when the bulb is seated in the light socket, the coupling providing electrical connection between the terminals and the electrical power source so that current flows through the bulb when seated in the socket, the socket including: a lighting element coupled to the socket and having two terminals, the lighting element terminals coupled to the light string leads and making electrical connection therewith for providing current to the lighting element, the lighting element having a sensor for sensing a voltage applied across the socket terminals, the sensor being triggered when the sensor detects a change in the supplied voltage across the socket terminals, the sensor allowing current to pass through the lighting element in response to the trigger.

In various aspects of this embodiment, the lighting element includes a turn-on voltage applied across the lighting element terminals, the sensor being triggered when the turn-on voltage is exceeded; or the lighting element is one of an LED, an electroluminescent element, or an organically deposited lighting structure; or the light bulb contains a plurality of lighting elements, the socket lighting element further including a plurality of sub-elements, the light bulb and the socket lighting element each having a third terminal, the third terminal of the bulb coupled to the third terminal of the socket lighting element when the bulb is seated in the socket, the third terminal of the bulb electrically coupled at a point between two of the plurality lighting elements within the bulb, the third terminal of the socket lighting element coupled at a point between two of the plurality sub-elements within the socket lighting element, the socket lighting element having a turn-on voltage applied across the third terminal of the lighting element and one of the other terminals of the lighting element, the sensor being triggered when the turn-on voltage is exceeded, the sensor allowing current to pass to the sub-elements of the lighting element disposed between the third terminal and the one of the other terminals of the lighting element in response to the trigger. In yet other aspects of the invention, the light bulb contains an LED and the socket lighting element includes two, LEDs connected in series, one each of the two ends of the series-connected LEDs including one each of the lighting element terminals, the turn-on voltage of the two, series-connected LEDs in the lighting element being greater than a turn-on voltage of the LED within the bulb; or the light bulb is an incandescent bulb and the lighting element includes two, LEDs and a resistor all connected in series, one each of the two ends of the series-connected LEDs and resistor including one each of the lighting element terminals, the turn-on voltage of the two, series-connected LEDs and the resistor in the lighting element being greater than a turn on voltage of the bulb; or the light bulb contains two cross-coupled LEDs such that one of the LEDs within the bulb is illuminated when the current through the light bulb is in one direction and the other of the LEDs within the bulb is illuminated when the current through the light bulb is in the other direction, the socket lighting element further including at least two sub-elements, the socket sub-elements each including two cross-coupled LEDs, such that one of the LEDs within the sub-element is illuminated when the current through the sub-element is in the one direction.

In another particularly preferred embodiment of the invention, A light socket collar is provided for coupling to a light socket, the light socket providing power to a light bulb, the light socket having two terminals coupled to two light string leads, the light string leads coupled to an electrical power source to provide current to the socket through the two light string leads, the terminals coupled to the bulb when the bulb is seated in the light socket, the coupling providing electrical connection between the terminals and the electrical power source so that current flows through the bulb when seated in the socket, the collar including: a housing having a socket connection end, the housing coupled to two terminals, the terminals extending outside the housing at the socket connection end, the housing including a lighting element coupled to the housing and having two terminals, the lighting element terminals coupled respectively to the housing terminals and making electrical connection therewith for providing current to the lighting element, the lighting element having a sensor for sensing a voltage applied across the housing terminals, the sensor being triggered when the sensor detects a change in the voltage applied across the housing terminals, the sensor allowing current to pass through the lighting element in response to the trigger.

In particular aspects of this embodiment the lighting element includes a turn-on voltage applied across the lighting element terminals, the sensor being triggered when the turn-on voltage is exceeded; or the lighting element is one of an LED, an electroluminescent element, or an organically deposited lighting structure; or the light bulb contains an LED and the socket lighting element includes two, LEDs connected in series, one each of the two ends of the series-connected LEDs including one each of the lighting element terminals, the turn-on voltage of the two, series-connected LEDs in the lighting element being greater than a turn-on voltage of the LED within the bulb; or the light bulb is an incandescent bulb and the lighting element includes two, LEDs and a resistor all connected in series, one each of the two ends of the series-connected LEDs and resistor including one each of the lighting element terminals, the turn-on voltage of the two, series-connected LEDs and the resistor in the lighting element being greater than a turn on voltage of the bulb. In still other aspects, light bulb contains two cross-coupled LEDs such that one of the LEDs within the bulb is illuminated when the current through the light bulb is in one direction and the other of the LEDs within the bulb is illuminated when the current through the light bulb is in the other direction, the socket lighting element further including at least two sub-elements, the socket sub-elements each including two cross-coupled LEDs, such that one of the LEDs within the sub-element is illuminated when the current through the sub-element is in the one direction.

In yet another preferred embodiment of the present invention, a light socket is providing for supplying power to a light bulb, the light socket having two terminals coupled to two light string leads, the light string leads coupled to an electrical power source to provide current to the socket through the two light string leads, the terminals coupled to the bulb when the bulb is seated in the light socket, the coupling providing electrical connection between the terminals and the electrical power source so that current flows through the bulb when seated in the socket, the socket including: a lighting element coupled to the socket and having an activation terminal; and a sensor coupled to the light socket and the terminals for sensing a voltage applied across the socket terminals, the sensor coupled to the activation terminal, the sensor being triggered when the sensor detects a change in the voltage applied across the terminals, the sensor sending a signal to the activation terminal, the lighting element illuminating upon receipt of the signal at the activation terminal. In one aspect of this embodiment, the lighting element is a fluorescent or electroluminescent light.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1A:
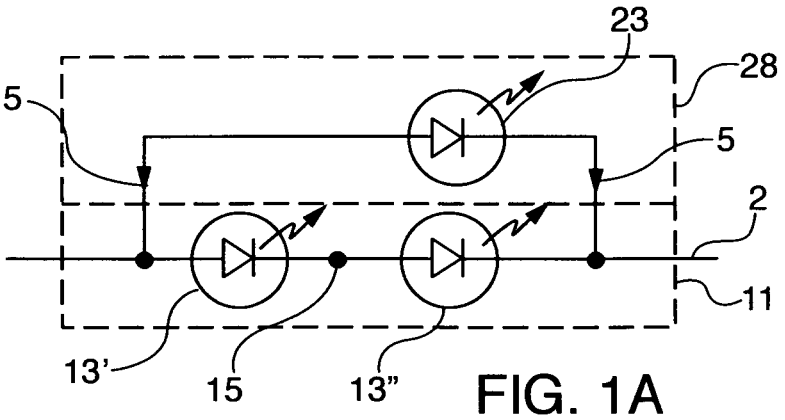
FIGS. 1A & 1B show generalized circuit diagrams according to two embodiments of the system of the present invention.

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that certain aspects of the present invention may be implemented in various forms of hardware, software, firmware, special purpose processors, or a combination thereof. Preferably, certain aspects of the present invention may be implemented in software as a program tangibly embodied on a program storage device. The program may be uploaded to, and executed by, an electronic machine comprising any suitable architecture. Preferably, certain aspects of the invention are implemented on a computer platform having hardware such as one or more central processing units (CPU), a random access memory (RAM), and input/output (I/O) interface(s). The computer platform may also include an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computers or devices may be interconnected using any existing or later-discovered networking technology and may also all be connected through a lager network system, such as a corporate network, metropolitan network or a global network, such as the internet.

A light string of LED lights is typically powered by DC current and has a multiplicity of LED bulbs. The number of light bulbs on the string can be as few as two and as many as the applied DC voltage and safe operational current requirements allow. Individual light strings may be connected in series containing many strings and associated lights. In this arrangement, DC bias voltage must be monitored to safely maintain power to the entire light string. In strings with replaceable LED bulbs, the bulbs or internal parts thereof occasionally fail. They may burn out, become loose in their socket and/or may be removed from the light string. Typically, in these failure situations, the remaining LEDs in series with the faulty bulb are left without a DC bias voltage and remain unlit. As a consequence, each of the unlit bulbs in that unbiased series of bulbs requires individual investigation and testing, one at a time, to determine the faulty bulb. Series-connected incandescent light string systems suffer the same drawbacks. That is, when a large number of series connected sockets and associated bulbs are accommodated and one or more bulbs fail, the remaining, otherwise lighted portions of the string are affected. As with LED light strings, incandescent light string failure mechanisms include bulb filaments or resistance shunts being burnt out, or the bulb becoming loose or removed. Also as with LED light strings, these faults typically cause all the bulbs in series with the faulty bulb or socket to go out as well, again resulting in an arduous search for the defective bulb.

There are numerous mechanisms within decorative holiday lighting strings systems that provide for light string illumination continuity when a single LED or incandescent bulb is removed. However, when a bulb is removed from its socket, it is often difficult to find that socket again, especially on a heavily decorated tree or a large outside display. This problem is exacerbated in a low light environment. Particularly in incandescent light string systems, non-resistive spring shunts within the sockets actually present a safety hazard in that the overall supply voltage applied over each of the remaining bulbs increases as does the current. This results in increasingly dangerous and unsafe operation of the light string as more bulbs are removed.

The present invention provides for illumination of the socket itself when a LED or incandescent bulb burns out or is removed from its socket thereby making the socket containing the faulty bulb easy to locate during replacement. The detection capability can be further enhanced if the color of the socket illumination is different than that provided by the LEDs on the light string. In the case of an LED light string, using present invention, the illumination color of the LED socket may be of a different color to than that of the primary LED bulb, thereby providing a further distinguishing aspect to socket identification. In the case in which all the bulbs in an incandescent light string go out, then all the sockets are illuminated. The present invention provides the capability for increased visual attention to problem sockets by illuminating those sockets. In certain embodiments, the other lights on the series-connected string may also be extinguished, thereby making the faulty bulb/socket easier to locate.

This invention also provides an apparatus for illuminating individual light string sockets while allowing remainder of the light string to operate. In the case of an incandescent light string using the present invention, it may be further desirable to extinguish the remaining bulbs in the light string series while illuminating the socket with the defective bulb for easy location and reducing the current in the light string for improved safety. Further, the removal of an LED bulb typically results in the remainder of the light set staying lit.

In one simple arrangement, the illumination function on the socket may consist of two, colored LEDs disposed on or within the socket. For example, they may be disposed within either in an opaque plastic ring or a colored ring, at the top of the socket. This arrangement is shown in the attached figures. Other locations and arrangements of the socket illumination are envisioned, including the number and color of socket lighting elements. Some of these arrangements have implications on the construction of the illuminating LED bulbs themselves. In the case of white LED bulbs, the coloration of the ring itself may be used to identify the faulty bulb and may display any of a plurality of colors. If the ring is clear or mildly opaque, proper LED color selection may be exercised so that the socket color is different from that of the light bulbs in the light string itself.

As an operational example, two series-connected LEDs may be connected across the socket terminals and disposed within the outer, upper ring within the light socket. When a single LED light bulb is inserted into the socket, the voltage applied across the socket is simultaneously applied across the bulb's single LED and the series-connected socket LEDs. Assuming that the turn-on bias of the series-connected LEDs exceeds that of the single bulb LED, only the bulb LED will be positively biased. The series-connected socket LEDs do not illuminate since their combined turn-on bias voltage is not exceeded. When and if the bulb LED burns out, is removed or otherwise stops drawing sufficient current, the voltage across the series-connected socket LEDs increases up to the point of their end-to-end turn-on bias voltage at which point the overall series is positively biased and the socket LEDs illuminate.

Figure 1B:
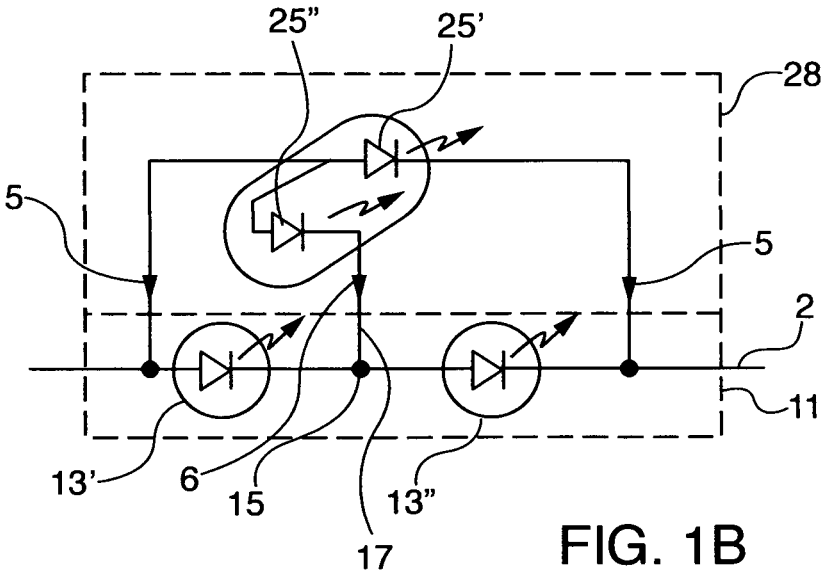

FIGS. 1A and 1B show a pair of electrical circuit diagrams. Diagrammatically, FIG. 1A shows a single LED bulb 28 and socket having two or more, series-connected, anode-to-cathode, DC-powered socket LEDs 13' and 13". Socket LEDs 13' and 13" are electrically connected in series and end-to-end connected to socket terminals 5. Socket LEDs 13' and 13" may be contained within one or more physical bulbs and/or embedded within the socket or a socket collar, possibly in combination with a protective coating. Bulb 28 is inserted in the socket and its leads are electrically connected to socket terminals 5 as well. In proper operation, the voltage, as applied by the light string power source along light string socket leads 2 and across terminals 5, appears across LED bulb 28 containing LED 23 as well as the series-connected socket LEDs 13' and 13." As an important design consideration, the two series-connected socket LEDs 13', 13" are selected such that the end-to-end turn on bias of the two LED's is greater than that of the LED bulb 28. Thus in proper operation, the bulb LED 23 will be forward biased and turn on. The two socket LEDs will remain unbiased and unlit. When the bulb LED burns out, or it is removed from the socket, the voltage across terminals 5 rises to the point of the end-to-end turn on bias of the two series-connected socket LEDs. At this voltage, both socket LEDs are forward biased and they illuminate so at to identify the socket containing the bulb failure.

Throughout the specification, the overall element that provides the socket illumination is referred to as the socket lighting element (SLE). The socket lighting element, in general, includes the actual elements that provide the illumination within the socket, i.e. LEDs, electroluminescent structures, etc. in combination with any associated components or circuitry necessary to operate the socket lighting elements. In the case of socket LEDs, the terminal voltage across terminals 5 rises until the voltage across the series-connected LEDs reaches their combined bias voltage at which point they illuminate. Other, more sophisticated arrangements of SLE's my include sensors that detect electrical conditions, printed circuit board having integrated circuits thereon, special turn-on devices such as the oscillator needed for electroluminescent lights and others. In the broadest abstract arrangement, the SLE is a "black box" containing printed wiring boards with circuitry, and voltage and current sensors etc. that detect bulb problems. Once detected, activation signals or triggers are conveyed to the socket lighting element according to the method appropriate for that element. Finally, the overall SLEs will typically have two (sometimes three) terminals which are used as the primary connection points within the socket to achieve electrical connection thereto for powering and operating the SLE.

FIG. 1B shows a second electrical circuit diagram in which the bulb 28 has a primary LED 25' and a secondary LED 25". A third bulb terminal is included as part of the physical structure of the bulb. As in FIG. 1A, socket LEDs 13' and 13" are electrically connected in series and connected to socket terminals 5 at their series end connection points. The third bulb terminal is electrically connected at third socket terminal 6 coupled to third socket lead 17 and then to circuit junction 15 between the two series-connected socket LEDs. Within LED bulb 28, the primary and secondary LEDs have their anodes connected to one another and to the anode of the series connection socket LEDs. The secondary LED's cathode, however, exits the bulb base at the bulb's third terminal and connects to third socket terminal 6. In proper functioning operation, the voltage, as applied by the light string power source across terminals 5, also appears across LED bulb 28 containing primary bulb LED 25' and the series-connected socket LEDs 13' and 13." The following are a set of operational design requirements for the arrangement of FIG. 1B: the primary bulb LED 25' has the lowest turn-on bias voltage; the end-to-end series-connected combined bias voltage of the secondary bulb LED 25" and the one socket LED 13" has the second highest turn-on bias voltage; and the end-to-end series-connected socket LEDs 13' and 13" have the third highest combined turn-on bias voltage. In this arrangement, the socket voltage applied at terminals 5 will bias the primary bulb LED only in normal operating conditions leaving all other LEDs unbiased and off. If the primary bulb LED 25' burns out, the series-connected secondary bulb LED 25" and socket LED 13" have the next lowest combined bias voltage and the voltage across the thermals 5 will appear across these two LEDs thereby biasing them and illuminating both. This provides a distinct and unique visual indication, at socket LED 13," that the primary LED in the bulb is burned out in that socket and needs to be replaced. If both the primary and secondary bulb LEDs 25' and 25" burn out, then both socket LEDs 13' and 13" illuminate thereby indicating this condition. It should be realized that identification of a secondary bulb LED failure can be indicated as well, if desirable, by selecting the combined bias voltage of series connected socket LED 13' and primary bulb LED 25' to be less then socket bulb 13". In this case, the first socket LED 13' will illuminate indicating a secondary LED bulb 25" failure.

A few design considerations should be apparent to those of skill in the art in the proper selection of LEDs when designing the system of FIGS. 1A and 1B. One such consideration is LED color selection. Any color combination among LEDs 13', 13", 25' and 25" may be made to indicate the bulb and socket's operational state. In FIG. 1B, for example, selection of different colors for socket LED's 13' and 13" will result in identifying the various bulb LED errors above. Selection of different colors for bulb LED's 25' and 25" will likewise result in identifying the various bulb LED errors above, and if selected to be the same color, will result in the continuous proper illumination of the light string with error indications being relegated to socket LED illumination patterns.

A second design consideration is the selection of LED bias voltages. As described above, particularly in connection with FIG. 1B, the proper selection of LED biases will provide unique identifying LED illumination patterns that are capable of conveying the source of the light string failures. With respect to both FIGS. 1A and 1B, the combined bias voltages of the LEDs that are illuminated under proper bulb operation conditions may be selected to be only slightly greater than the combined bias voltages of the LEDs that are illuminated under bulb failure conditions. This results in maintaining a sufficiently constant current in the light string during LED bulb failures, which is an important safety consideration in modern lighting systems. In particular, modern light string regulations are being considered that limit the overall current rise within a light string containing a bulb failure. Examples of other apparatus and methods that provide such current limitations are provided in co-owned U.S. patent application Ser. No. 13/999,674 filed Mar. 17, 2014 entitled APPARATUS AND METHOD FOR PROVIDING A RESISTIVE SHUNT WITHIN A LIGHT STRING, the contents of which is incorporated by reference herein in their entirety.

Figure 2A:
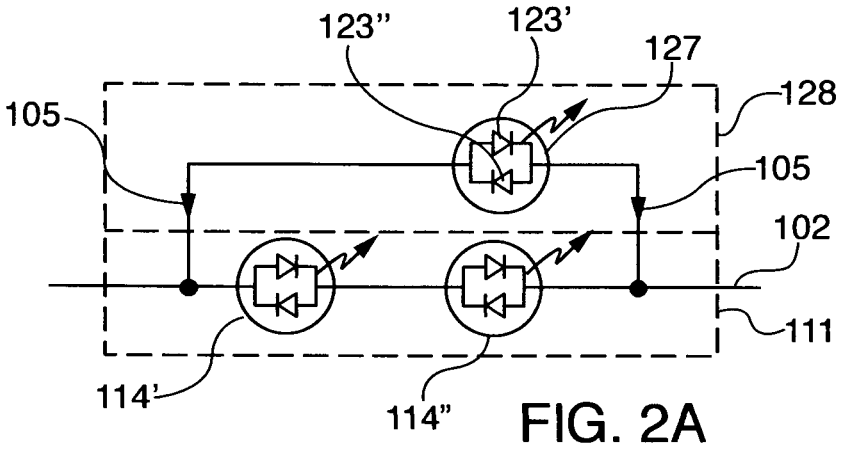
FIGS. 2A & 2B show generalized circuit diagrams according to two additional embodiments of the system of the present invention.
Figure 2B:
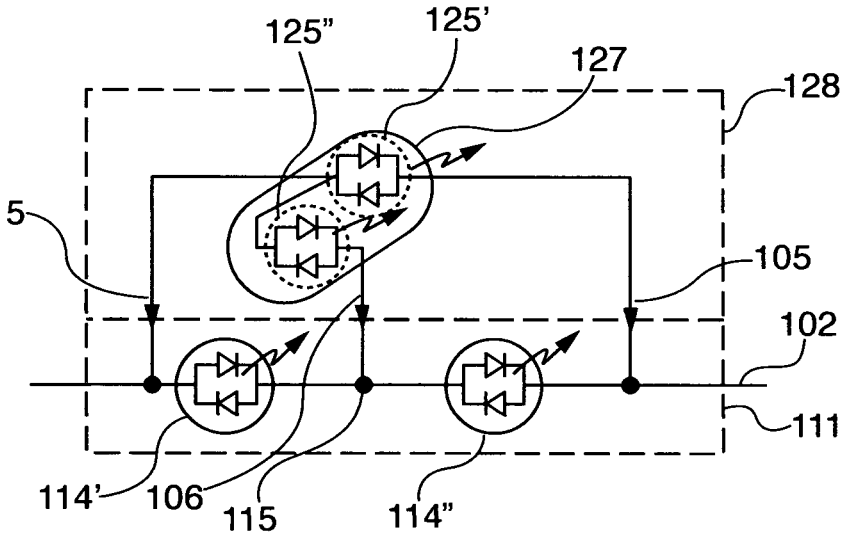

FIGS. 2A and 2B also show a pair of electrical circuit diagrams similar in overall structure and function to those provided in FIGS. 1A and 1B. FIGS. 2A & 2B differ in that all the single color LEDs of FIGS. 1A & 1B are replaced by two color ("Dual Color") LED packages 127 and 114'/114". The light strings of FIGS. 2A & 2B are depicted showing one socket and one bulb. FIG. 2B provides dual, cross coupled LED pairs to provide for the primary bulb element 125' and secondary bulb element 125". As in FIGS. 1A & 1B, the lighting system is DC-powered with two or more LEDs contained within one bulb in each light socket. However, in the Dual Color LED scheme, only one DC current direction is supplied at a time, thus illuminating one of the two LEDs in each cross-coupled pair. Otherwise, on a cross-coupled LED pair basis, FIGS. 2A & 2B have substantially the same functional operation as described in connection with that provided in FIGS. 1A & 1B for each of the two DC current directions capable of being provided at terminals 105.

In FIGS. 2A & B, socket terminals 105 accept input DC voltages from light string leads 102 and provide connectivity within the bulb socket to LED bulb 127. Bulb LEDs 123' and 123" are the illuminating bulb elements within LED bulbs 127. Socket LEDs 114' and 114" are connected in serried between terminals between terminals 105 and have a circuit juncture between them at 115. Socket LEDs also have dual, cross coupled LEDs within them. Terminal 106 is provided in FIG. 2B to provide electrical coupling to the third terminal of bulb 128. It should be noted that certain LED orientation considerations are important in the embodiment shown in FIGS. 2A and 2B to achieve a proper and desired color scheme within each bulb-socket pair as well between bulb-socket pairs along the light string. As described below, the third socket terminal in FIG. 2B may provide registration assistance with respect to the orientation of the LED bulb 127 within the light socket.

The same design considerations provided with reference to FIGS. 1A & B above are also applicable to the system designs shown in FIGS. 2A and 2B. Particularly with respect to color, the Dual Color nature of the LED bulbs 127 and socket LEDs 114' and 114" provide a number of variations of color schemes. For example, different colors may be used in the upper and lower LEDs within socket LEDs 114' and 114" to indicate the specific LED that has failed within the Dual Color LED bulb 127. Similarly, all LED bias voltages among all Dual Color bulbs may be manipulated to accommodate any of a plurality of conceivable LED lighting sequences and arrangements.

Figure 3:
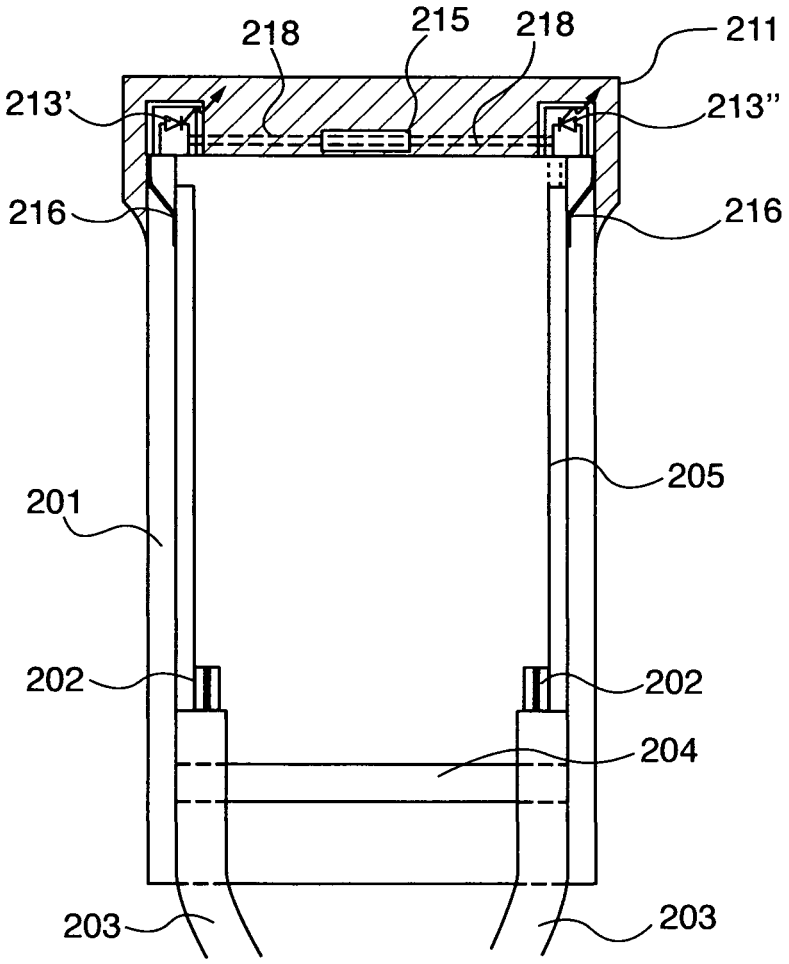
FIG. 3 shows a sectional side view of one particular physical embodiment of a light socket wired according to the circuitry provided in FIGS. 1A & 2A.

FIG. 3 is a cutaway side view of an LED socket according to the embodiment shown in FIGS. 1A & 2A of the present invention. Two socket LED bulbs 213' and 213" are provided in series within a clear annular ring portion, socket collar 211, at the top of socket body 201. Light string leads 202 are provided to supply electrical power from a light string power source provided on light string wiring 203 and are physically and electrically coupled to socket terminals 205 and then to socket LED leads 216 within the socket. In this embodiment, the two terminals of the socket lighting element (SLE) are physically and electrically connected to the terminals. In alternative arrangements, the two SLE terminals may be connected directly to the light string leads or other appropriate power-providing leads. Socket LED interconnecting leads 218 couple the two socket LEDs 213' and 213" to one another at circuit junction 215.

Figure 4:
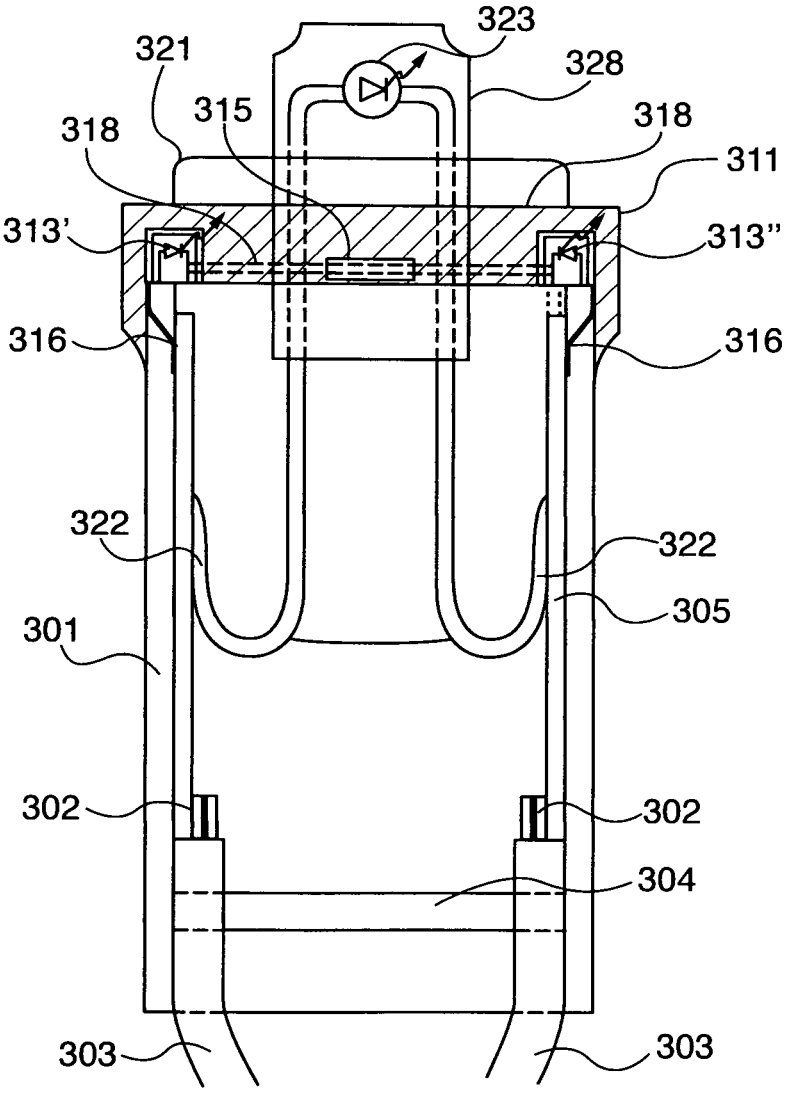
FIG. 4 shows the sectional side view of FIG. 3 with a bulb inserted into the light socket.

FIG. 4 is a cutaway side view of FIG. 3 with a bulb 328 inserted. Bulb leads 322 are in physical and electrical connection with the socket terminals 305 to provide power to the bulb 328 and bulb LED 323. LED bulb base 321 provides for a bulb insertion stopping mechanism when its lower surface contacts the upper surface of the socket collar 311. All other elements of FIG. 4 are numbered correspondingly as those identified in FIG. 3.

Figure 5:
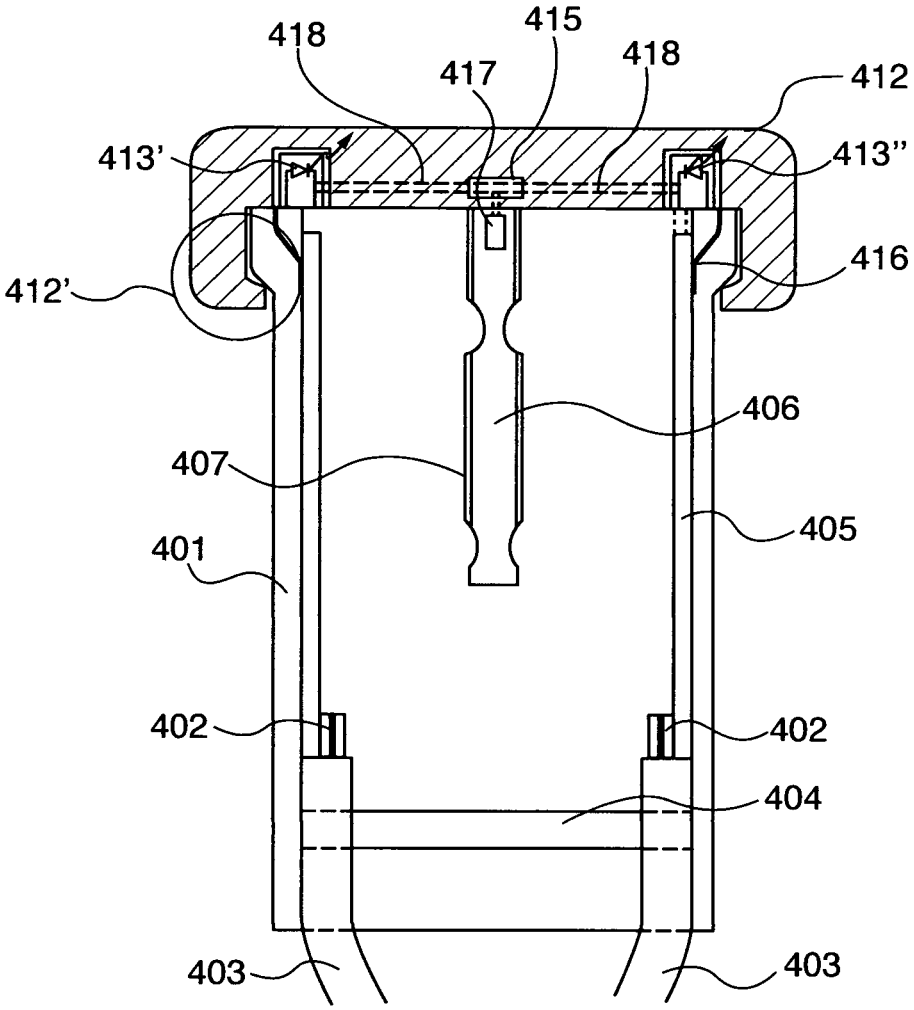
FIG. 5 shows a sectional side view of one particular physical embodiment of a light socket wired according to the circuitry provided in FIGS. 1B and 2B.
Figure 6:
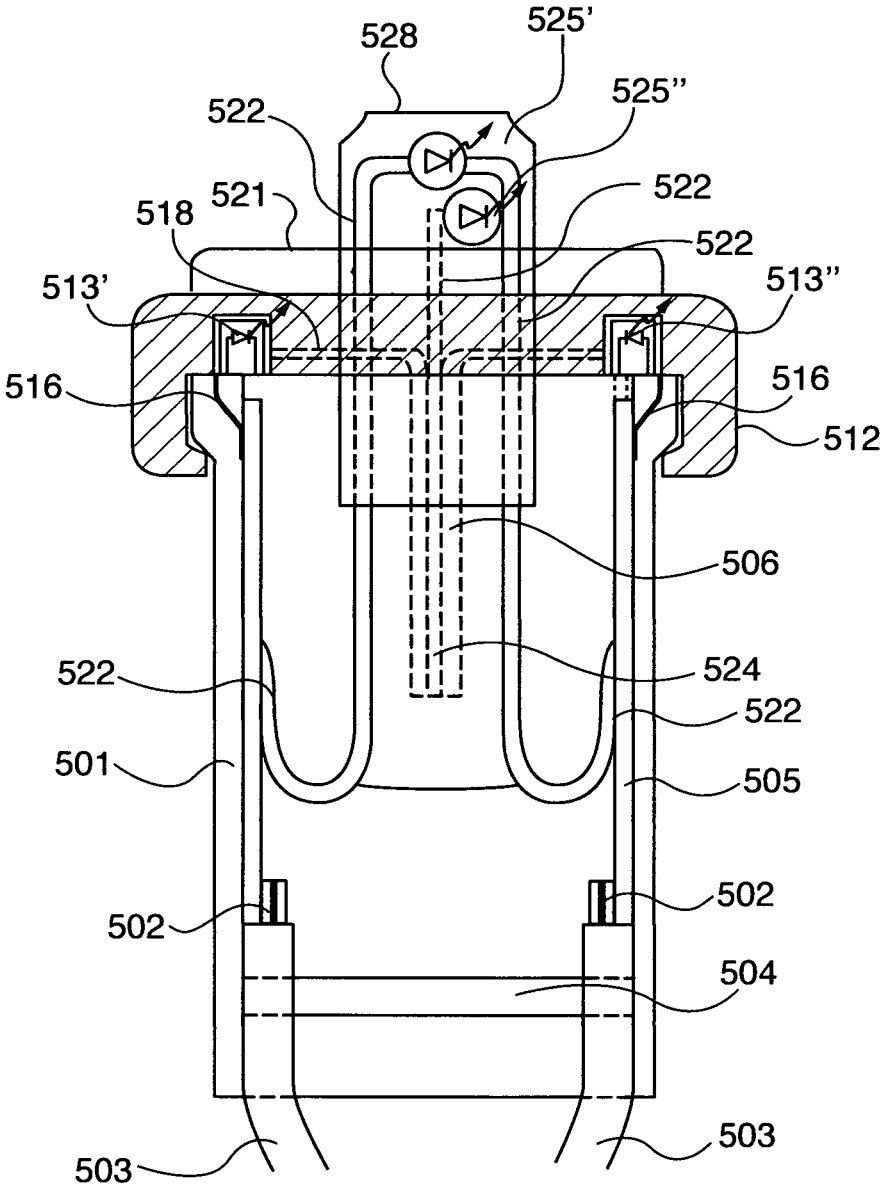
FIG. 6 shows a sectional side view of FIG. 5 with a bulb inserted into the light socket.

FIGS. 5 & 6 a cutaway side view of an LED socket according to the embodiment shown in FIGS. 1B & 2B of the present invention. As an added feature, the socket collar 412 containing engagement portion 412' is shown as a separately attachable element for snapable physical connection to socket body 401. Further, the elements of these sockets differ from those in FIGS. 3 & 4 in that they provide for electrical connection to the third bulb lead. In particular, third terminal receiver 407 is provided within socket body 401 to receive third socket terminal 406. Third terminal receiver may be physically provided as a channel within socket body 401, a set of extended clamping legs on the inner wall of the socket body 401 or as any other securing mechanism for receiving third socket terminal 406. Third socket terminal 406 is physically and electrically coupled to third socket lead 417 which in turn is electrically coupled to circuit junction 415 and to socket LEDs 413' and 413". FIG. 6 shows the socket of FIG. 5 with LED bulb 528 inserted into socket body 501. Primary and secondary bulb LEDs 525' and 525" respectively are shown within LED bulb 528. Third bulb lead 524 of the LED bulb 528, previously identified in connection with FIGS. 1B & 2B, is shown as being in electrical and physical contact with third socket terminal 506. All other elements of FIG. 5 & 6 are numbered correspondingly as those identified in FIGS. 3 & 4.

Figure 7:
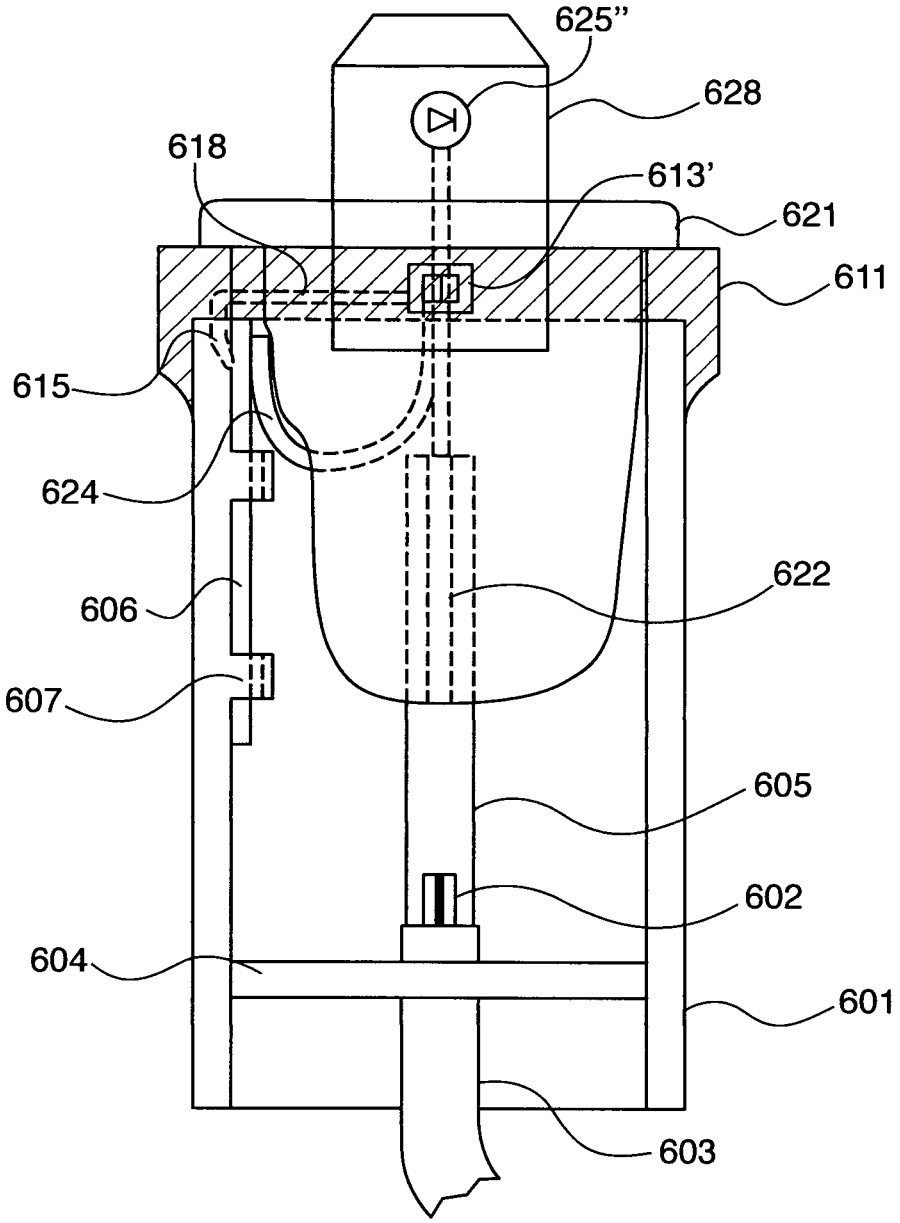
FIG. 7 is a 90 degree, clockwise rotated view of FIG. 6.

FIG. 7 is a 90 degree, counter-clockwise rotated (as viewed from the top of the socket), socket of FIG. 6. FIG. 7 provides more detail with respect to the added third socket terminal that is connected to the circuit junction of the two socket LEDs in the socket collar. All other elements of FIG. 7 are numbered correspondingly as those identified in FIGS. 5 & 6.

Figure 8:
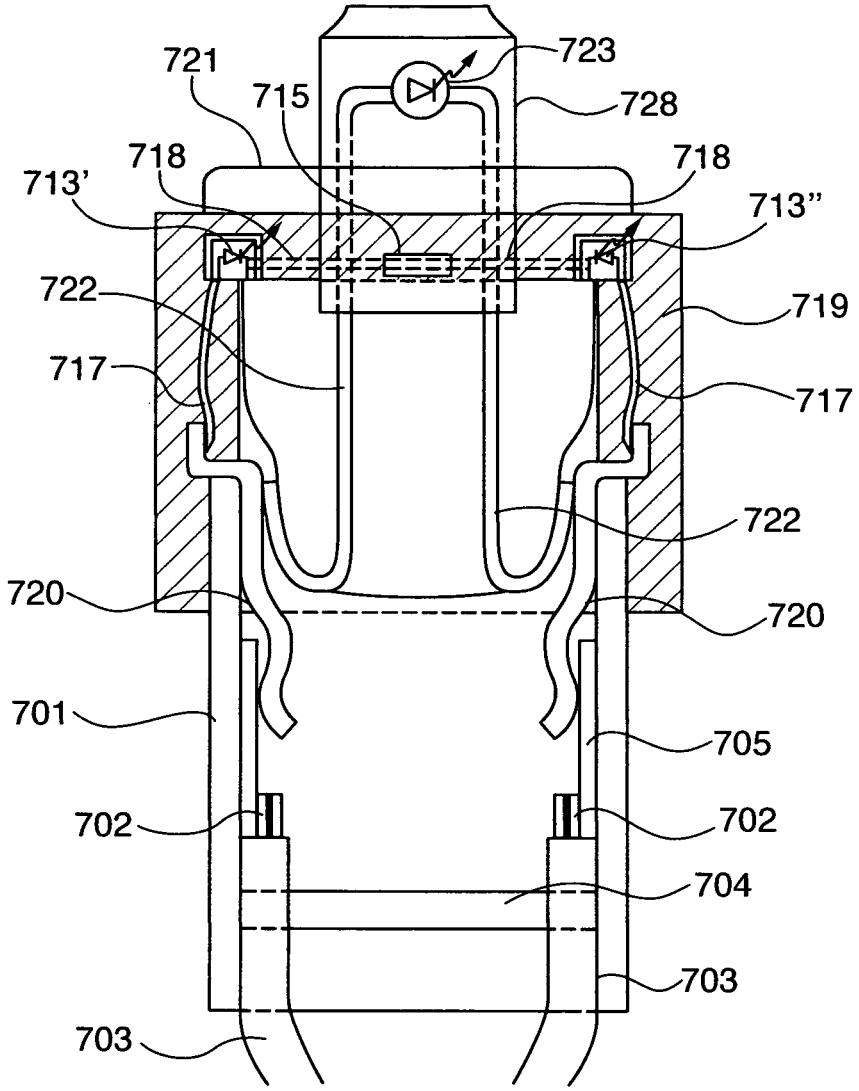
FIG. 8 shows a sectional side view of one particular physical embodiment of a light socket collar according to the circuitry provided in FIGS. 1A & 2A.
Figure 9:
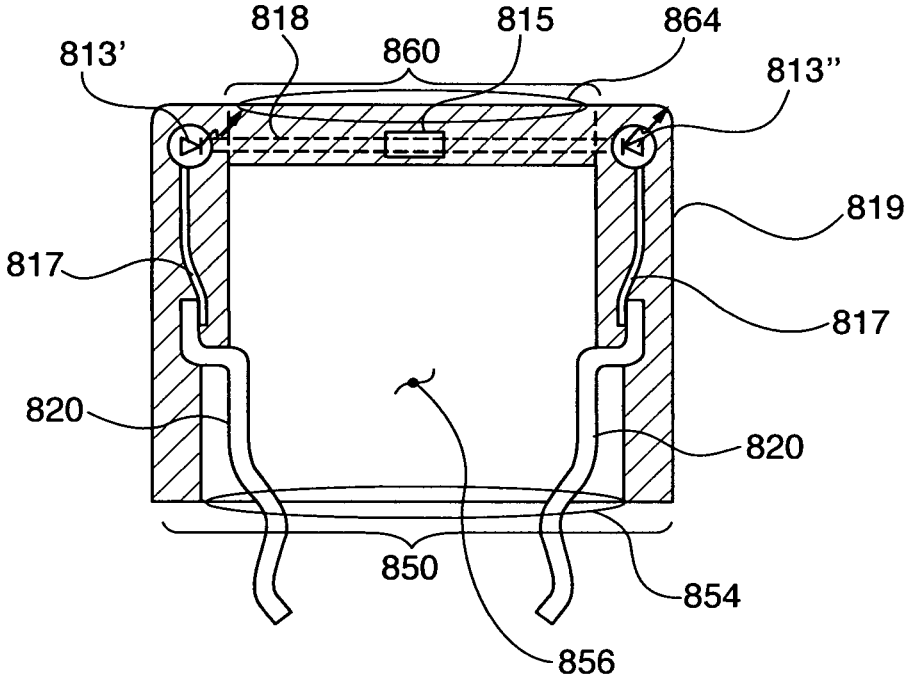
FIG. 9 shows a sectional side view of one particular physical embodiment of the light socket collar of FIG. 8 as inserted between a light socket and a bulb according to the circuitry provided in FIGS. 1A and 2A.

FIGS. 8 & 9 show cutaway views of a retrofit illuminating socket collar. FIG. 8 shows the retrofit collar 719 containing the SLEs as attached to the socket body 701. FIG. 9 shows a standalone illuminating socket collar 819. With respect to FIG. 9, connection end 850 is provided with open annular region 854 and volume 856 to provide for insertion of the collar 819 over existing light sockets. Also, connection end 860 is provided with open annular region 864 to provide for insertion of an LED bulb into the collar top in a fully assembled arrangement. Collar terminals 820 are coupled physically and electrically to the SLE connection leads 817 and extend downward and out of the connection end so as to provide electrical contacts for the collar within the light socket. The SLE connection leads 817 are, in turn coupled to the socket LEDs 813' and 813". FIG. 8 shows a cutaway side view of the retrofit Illuminating collar 719 as inserted over a light socket 701 and having the collar terminals 720 extending down into the light socket and making physical and electrical connection with socket terminals 705. Once LED bulb 728 is inserted into the retrofit illuminating collar 719 through open annular region 864, the retrofit illuminating collar 719 becomes physically interposed between the socket body and LED bulb 728 so as to provide a secure mechanical assembly. To the extent that the collar increases the overall distance between the top surface of the socket and collar assembly and the socket terminals, the downward extending collar terminals, are necessary to allow the bulb leads 722 to make the proper electrical connection while also powering the collar SLE. Other physical arrangements may be considered in which the collar terminals are contained entirely within collar. All other elements of FIGS. 8 & 9 are numbered correspondingly as those identified in earlier-presented figures.

Figure 10:
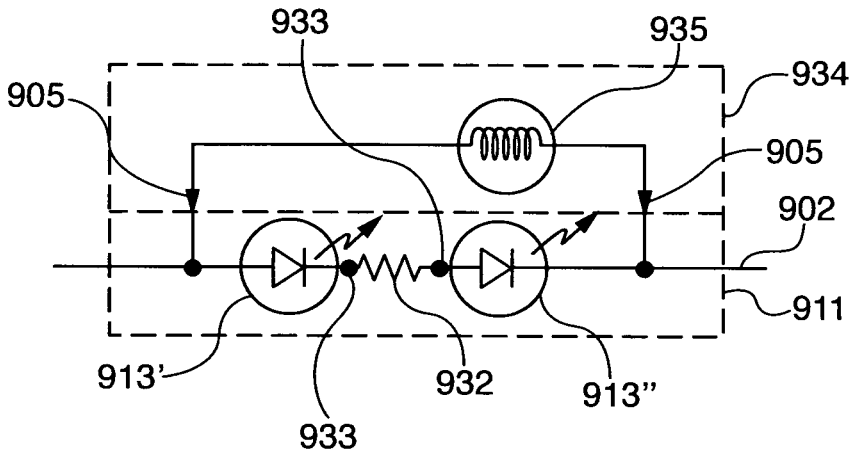
FIG. 10 show a generalized circuit diagram of another embodiment of the system of the present invention.

FIG. 10 shows an electrical circuit diagram similar to those provided in FIGS. 1 and 2 with the addition of a resistive element 932 between socket LEDs 913' and 913" and in the context of an incandescent light string containing an incandescent bulb 935. In an incandescent light string, it is desirable to provide a small resistor within the light socket to match the missing resistance of the filament when the bulb burns out. This allows the current through the incandescent light string to remain constant, the socket LEDs to be biased and the light string to operate safely when a bulb burns out. Alternatively, a properly sized, large resistor may be provided so that an incandescent bulb failure results in the entire light string being shut down. This may be conditioned so that with only one socket LED within the socket containing the failed bulb remains forward-biased. In the embodiment of FIG. 10, resistor 932 is inserted in series with socket LEDs 913' and 913" thereby replacing common circuit junction 15 with a pair of resistor junctions 933. In the filament matching arrangement, the resistor value is selected to match the resistance of a typical incandescent filament. In the arrangement in which the entire light string is shut off, a series resistor of 33,000 ohms or more may be used. In the single socket LED bias arrangement, the resistor is sized according to the characteristics of the socket LEDs within the socket or the collar. In any arrangement, the resistor ultimately either limits the current to a safe operational level for the LEDs when a bulb is removed or shuts off the light string entirely. However, with a resistor of large size, the overall light string current becomes negligible and will not result in visual indication of the socket in which the faulty bulb is sited. Once the faulty bulb is replaced the set returns to normal operation. Other than the resistor operation as describe below the circuit operation is substantially similar to that of FIGS. 1 and 2.

Figure 11:
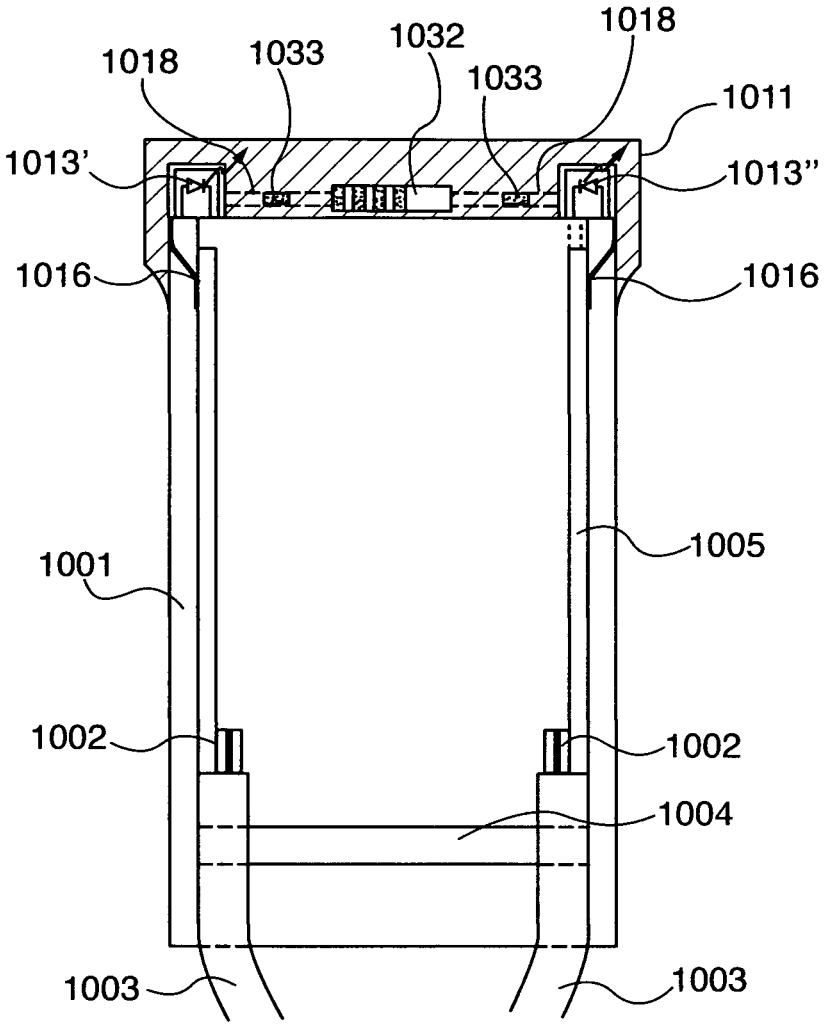
FIG. 11 shows a sectional side view of one particular physical embodiment of a light socket according to the circuitry provided in FIG. 10.
Figure 12:
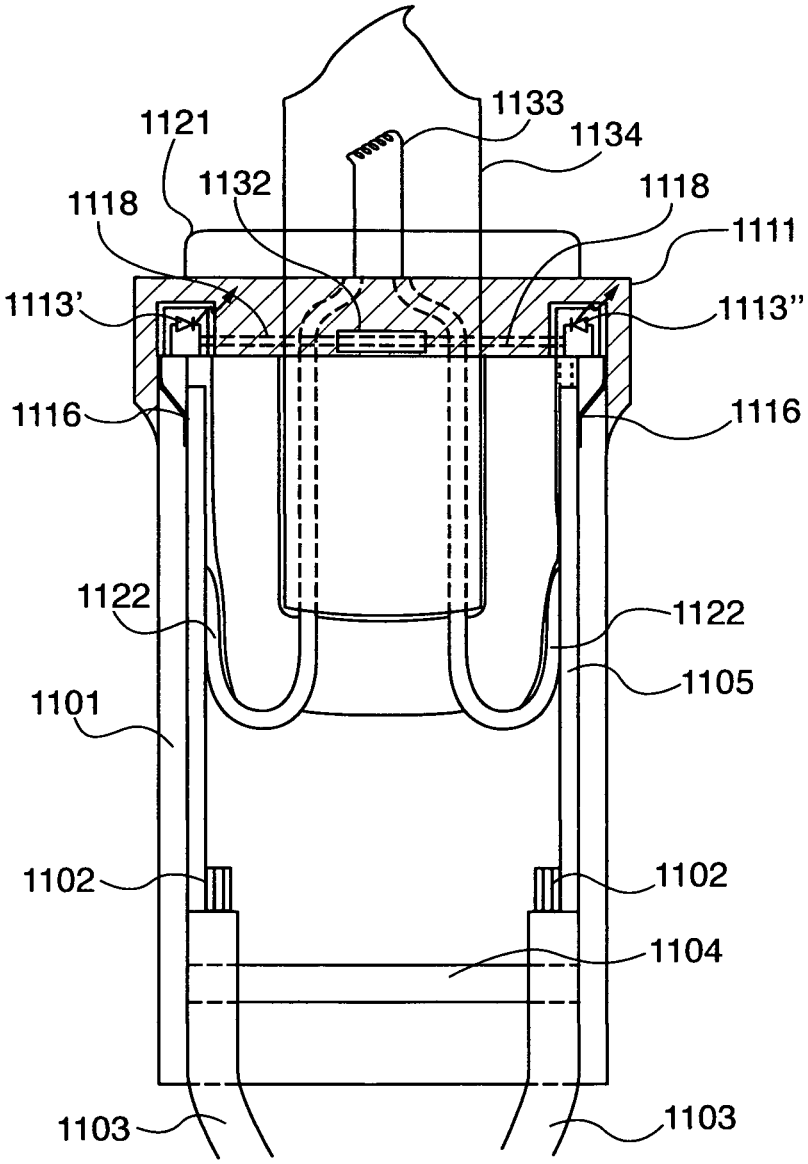
FIG. 12 shows a sectional side view of FIG. 11 with a bulb inserted into the light socket.
Figure 13:
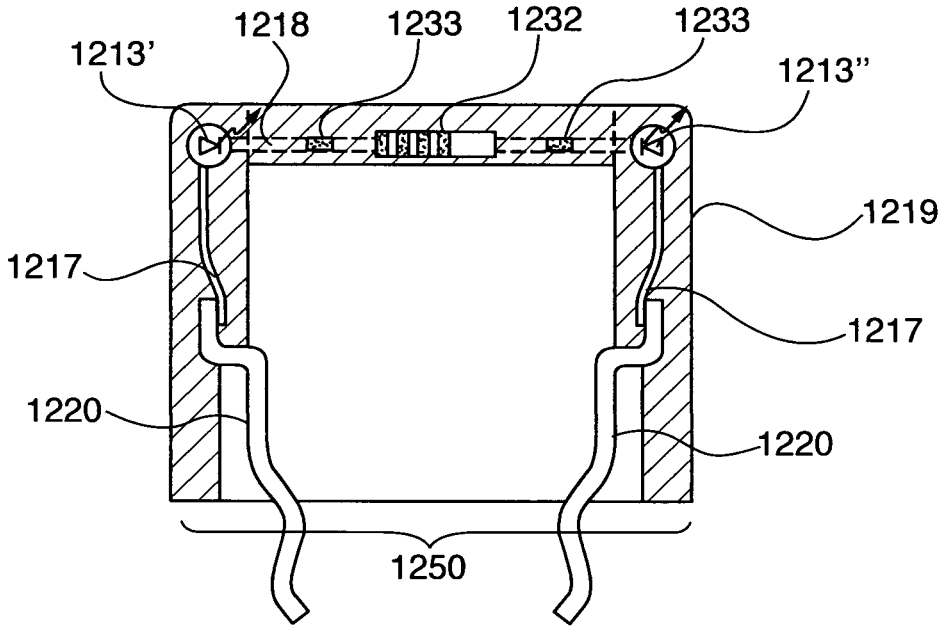
FIG. 13 shows a sectional side view of one particular physical embodiment of a light socket collar according to the circuitry provided in FIG. 10.

FIG. 11 shows a cutaway side view of socket 1001 according to one particular physical embodiment of the electrical circuit provided in the embodiment of FIG. 10. In particular, FIG. 11 shows, in detail, resistor 1032 embedded in the socket between socket LEDs 1013' and 1013." Lead securing device 1004 is additionally provided to ensure proper registration of the wire leads 1002 within the socket body 1001. FIG. 12 shows cutaway side view of the light socket of FIG. 11 with the incandescent bulb 1134 inserted in the socket 1101. FIG. 13 shows a cutaway side view of a retrofit illuminating collar 1219 for use in an incandescent light string. This embodiment is substantially similar to that provided in FIG. 8 but includes the series resistor 1232 within collar with collar terminals 1220 extending beyond the connector end 1250 which are to be inserted into an existing socket. All other elements of FIGS. 10-13 are numbered correspondingly as those identified in the previously presented figures.

Figure 14:
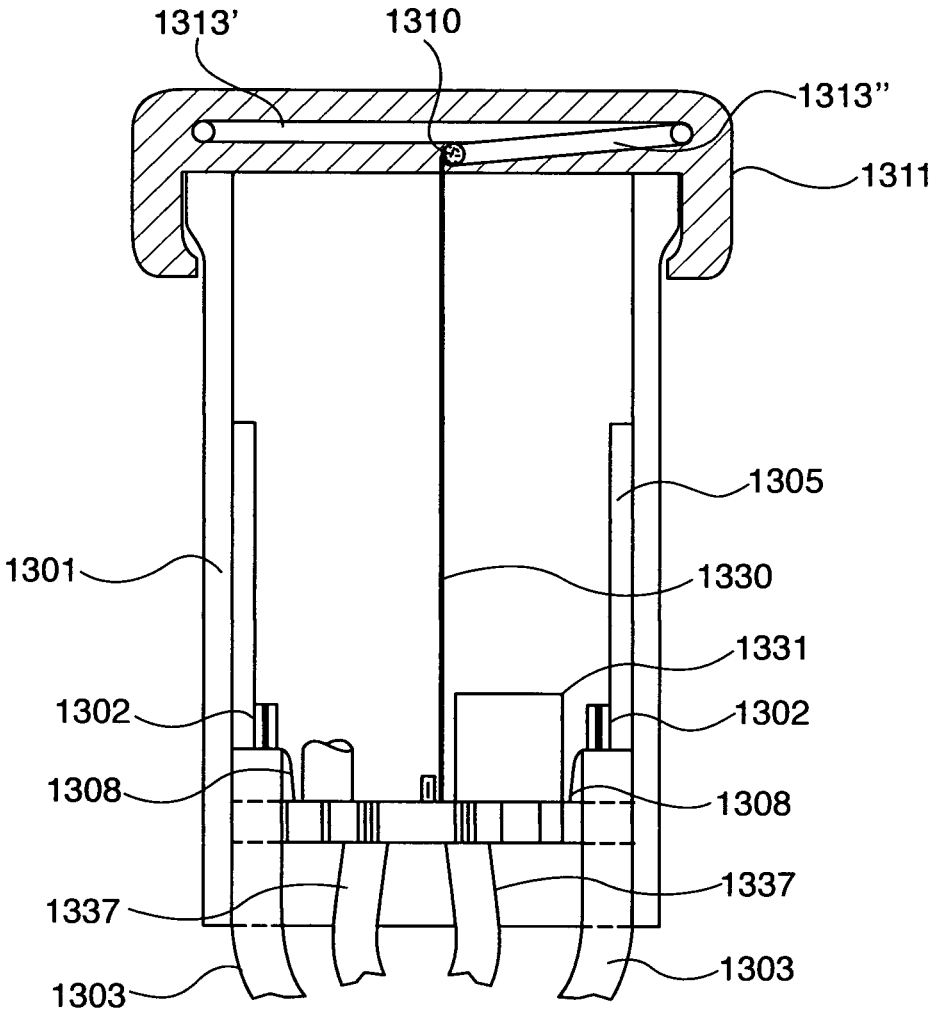
FIG. 14 shows a sectional side view of one particular physical embodiment of a light socket according to another embodiment of the present invention.

FIG. 14 is a cutaway side view of an LED socket according to another particular physical embodiment of the present invention. In this embodiment the SLE is one or more electroluminescent (EL) lighting elements 1313' and 1313" embedded within or otherwise physically coupled to the socket collar 1311. EL power and control (or signal) wiring 1330, electrically couples EL AC power supply wires 1337 and the EL control signaling from the EL control circuit board 1331 to the EL lighting elements 1313'/1313" at EL circuit junction 1310. EL control circuit board 1331 receives its power as well as voltage detection signaling from power supply leads 1308 which are coupled to the light socket power leads 1302. The circuitry on circuit board 1331 senses an open circuit (reduced current) at the connection between the socket terminals 1305 when the LED bulb is in a failure condition. When such a condition is sensed by the circuitry on the circuit board, a signal is provided on electroluminescent signal wire 1330 which causes electroluminescent lighting elements 1313' and 1313" to turn on.

Figure 15:
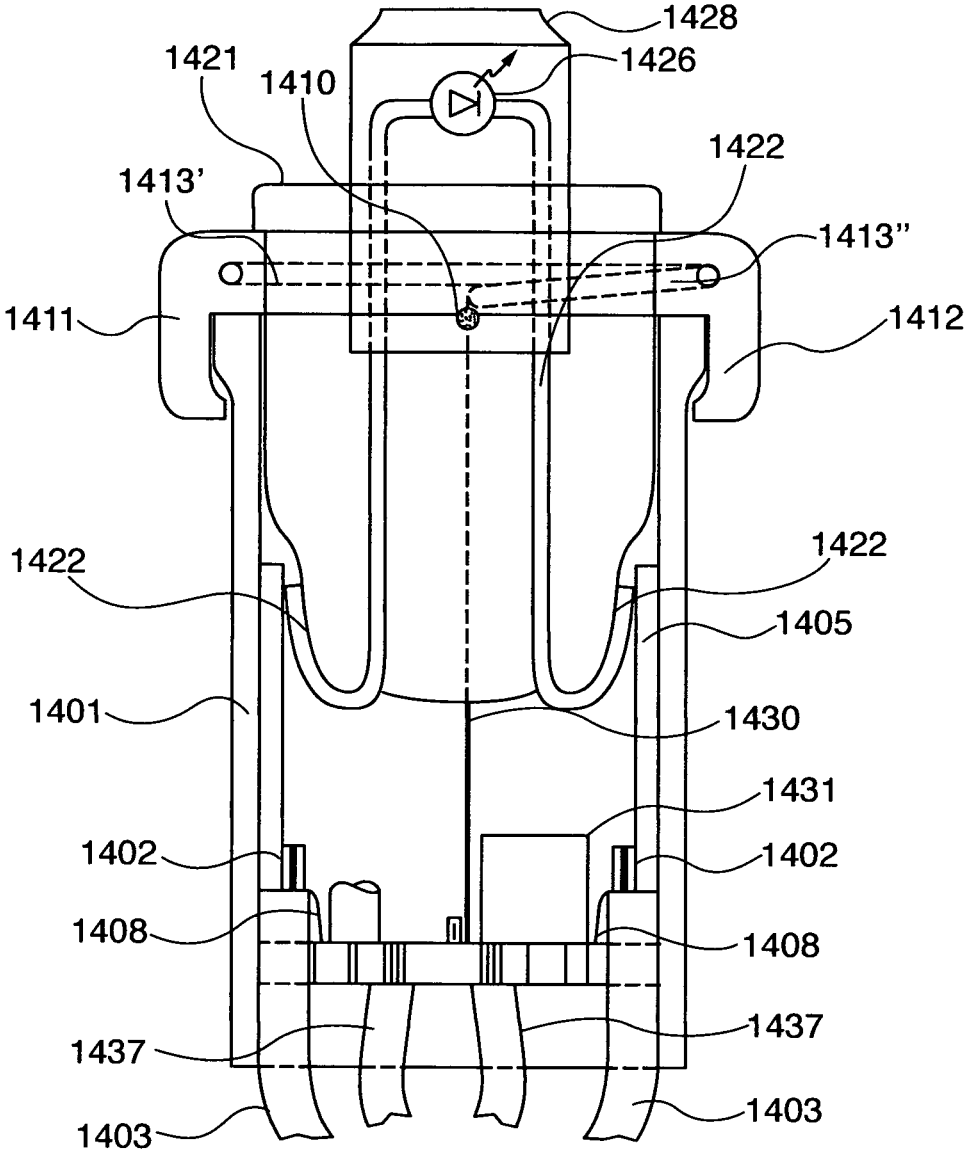
FIG. 15 shows a sectional side view of FIG. 14 with a bulb inserted into the light socket.

FIG. 15 is a cutaway side view of the light socket of FIG. 14 with a bulb 1428 inserted. All other elements of FIGS. 14 & 15 are numbered correspondingly as those identified in earlier-presented figures.

Figure 16:
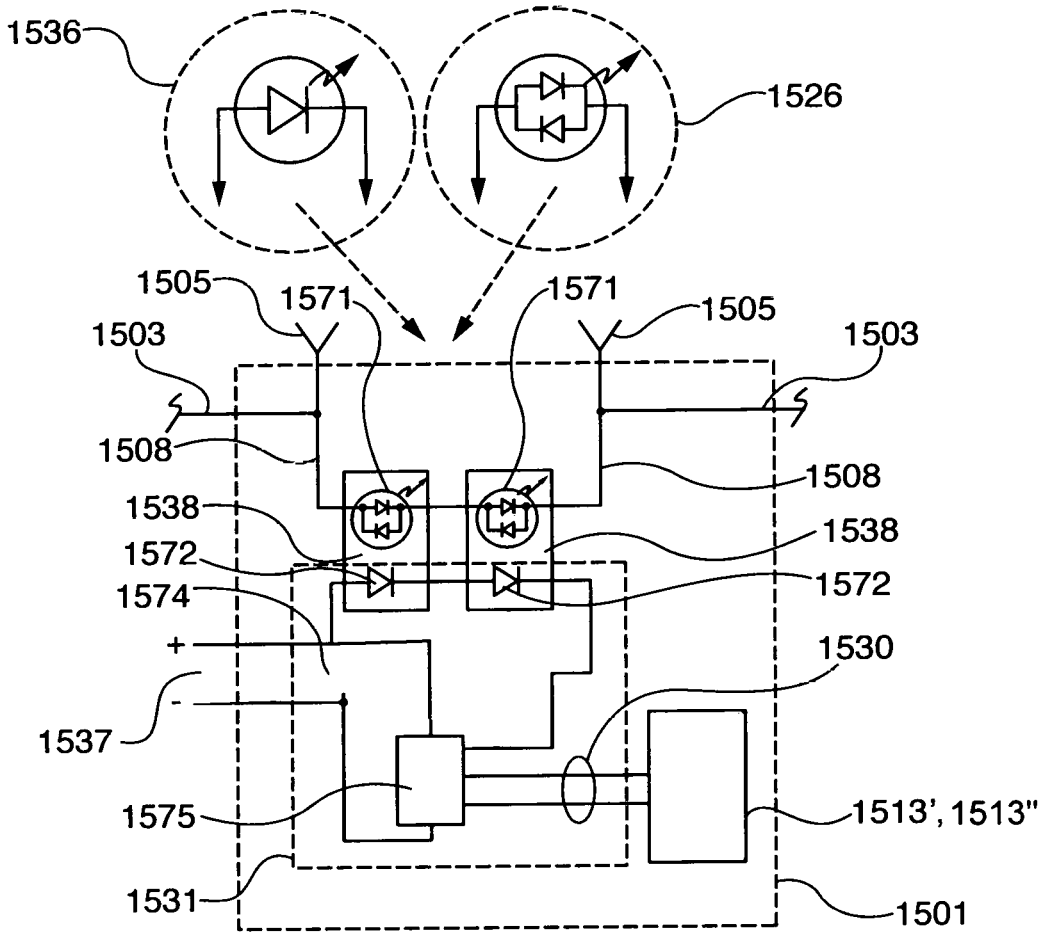
FIG. 16 shows a generalized circuit diagram according to another embodiment of the system of the present invention.

FIG. 16 shows another electrical circuit diagram containing an exemplary EL control circuit board 1531. Circuit board 1531 is shown as housed within socket body 1501 and receives supply voltage power from EL power supply wires 1508. Control circuit board 1531 contains advanced electronic circuitry including the EL illumination controller 1575 and photo coupler diodes (photo triacs) 1538, which are coupled to one another through various signal wiring 1574 within the electrical circuit. Illumination bulbs are shown in two different embodiments as 1526 and 1536 and are connected across terminals 1505. In the circuit of FIG. 16, the upper diode pairs 1571 of photo triac 1538 have a higher threshold bias voltages in each direction than the threshold bias of the corresponding illuminating bulb, 1536 or 1526. When the illuminating bulbs malfunction, the voltage across the terminals 1505 raises and the upper diodes 1571 within the photo triacs are forward biased and the upper diodes illuminate. This, in turn, triggers or biases the optical detector diodes (lower photo triac diodes) 1572 within the photo triac. This triggering sends a control signal to EL control circuitry 1575 which sends corresponding illumination signals on EL control signal wiring 1530 and allows AC power from EL AC power supply wires 1537 to pass through and on to EL lighting elements (SLEs) 1531' and 1531". It should be noted that EL control circuitry may also contain an oscillator so that separate EL AC power supply wires 1337 may be replaced by DC power supplied by EL power supply wires 1508 which is then converted to AC power signals and passed on to the EL lighting elements (SLEs) 1531' and 1531" through EL control signal wiring 1530.

Figure 17B:
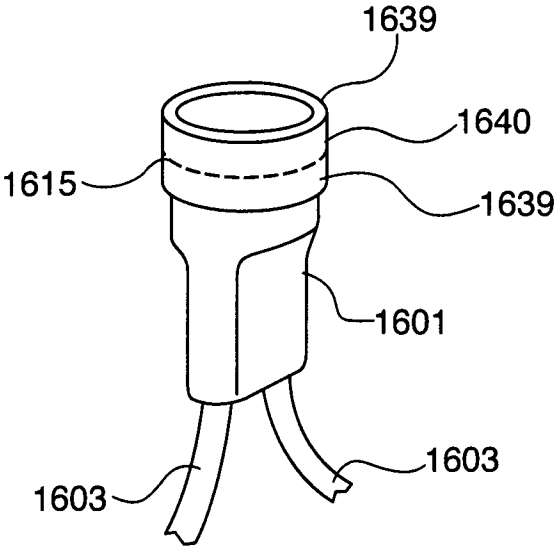
FIGS. 17A and 17B show oblique views of one particular physical embodiment of a light socket according to another embodiment of the present invention.
Figure 17A:
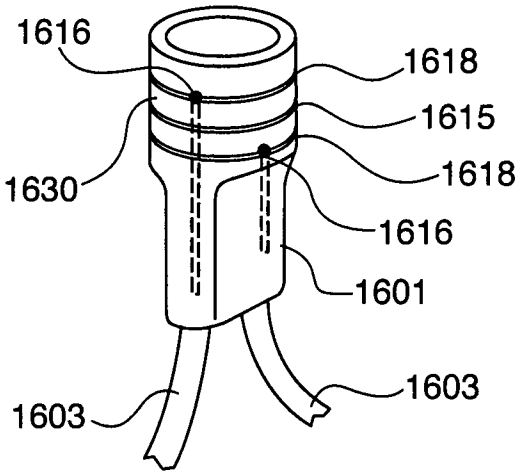

FIGS. 17A & 17B show an exterior oblique view of light sockets according to another embodiment of the present invention. In this embodiment, organically grown LEDs, are deposited on the exterior of the light socket and function as the socket LEDs. In FIGS. 17A & B, two electrical conductors 1618 are deposited or otherwise arranged in two annular bands around the top of 1601. Power is provided to conductors 1618 through the socket terminals 1616 which are ultimately coupled to light string wiring 1603 within the socket body. Control of the LEDs is provided through control wiring 1630. Organically grown LEDs 1639 are deposited on the socket surface in annular bands around the top of socket 1601 following the deposition of the electrical conductors 1618. Organically grown socket LED layers meet at LED junction 1615, in a full annular band around the socket. The socket LED bands 1639 must meet substantially around the entire socket circumference at this junction so as to provide sufficient electrical connection throughout the bands around the entire circumference of the socket. The LEDs are then coated with a semi-opaque or a clear sealant 1640 in a final coating process so as to preserve the integrity of the LED structures. Bias voltages are provided between electrical conductors 1618 when the LED bulb is not present in the socket such that the two bands are illuminated around the circumference of the socket. The band sizes and geometries are selected appropriately to achieve the proper bias voltages for each of the "surface mounted/organically grown LEDs." All three electrical conductors 1616 and 1618 are deposited on, embedded within or wired through the light socket and are ultimately provided within the socket interior for making the above-described connections. Various alternative LED striping arrangements are recognizable to achieve exotic color patterns or combinations or signaling on the exterior surface of the socket. Other types of deposited LEDs, such as Organic LEDs and Flexible Organic LEDs, are contemplated as being capable of similar utility and are considered within the scope of this invention.

While the invention has been shown and described with reference to specific preferred embodiments, it should be understood by those skilled in the art that various changes in form and detail may be made therein without departing from the spirit and scope of the invention as defined by the following claims.

What is claimed is:

1. A light socket for providing power to a light bulb, said light socket having first and second terminals, said first and second terminals coupled to a respective first and second light string leads, said first and second light string leads coupled to an electrical power source to provide current to said socket through said first and second light string leads, said respective first and second terminals coupled to respective first and second leads of said bulb when said bulb is seated in said light socket said electrical power source causing current to flow through said bulb between said first and second light socket terminals and said respective first and second light string leads when said light bulb is seated in said socket, said socket comprising:

a socket lighting element coupled to said socket and having first and second terminals, said first and second lighting element terminals coupled to said respective first and second light string leads and making electrical connection therewith for providing current to said socket lighting element, said socket lighting element having a sensor for sensing a voltage applied across said first and second socket terminals, said sensor allowing current to pass through said socket lighting element when said sensor detects a voltage change across said first and second socket terminals, said socket lighting element being illuminated upon said detected voltage change.

2. The light socket of claim 1 wherein said sensor is a bias voltage of said socket lighting element, said sensor allowing current to pass through said socket lighting element when said bias voltage across said first and second terminal of said socket lighting element is exceeded.

3. The light socket of claim 2 wherein said socket lighting element is one of an LED, an electroluminescent element, or an organically deposited lighting structure.

4. The light socket of claim 2 wherein said light bulb contains an LED and said socket lighting element comprises a first and a second LED connected in series, an anode of said first LED socket lighting element coupled to a cathode of said second LED socket lighting element, said uncoupled anode and said uncoupled cathode of said first and second LED socket lighting elements comprising one each of said first and second socket lighting element terminals, said bias voltage of said two, series-connected LEDs in said lighting element being greater than a bias voltage of said LED within said bulb.

5. The light socket of claim 2 wherein said light bulb is an incandescent bulb and said socket lighting element comprises two LEDs and a resistor all connected in series, one each of the two ends of said series-connected LEDs and resistor comprising one each of said first and second socket lighting element terminals, said bias voltage of said two, series-connected LEDs and said resistor in said lighting element being greater than a bias voltage of said bulb.

6. The light socket of claim 2 wherein said light bulb contains two cross-coupled LEDs such that one of said LEDs within said bulb is illuminated when the current through said light bulb flows in one direction and the other of said LEDs within said bulb is illuminated when the current through said light bulb flows in the other direction, said socket lighting element further comprising at least two sub-elements, said socket sub-elements each including two cross-coupled LEDs, such that one of said LEDs within said sub-element is illuminated when the current through said sub-element is in said one direction.

7. The light socket of claim 1 wherein said light bulb contains a plurality of bulb lighting elements, said socket lighting element further comprises a plurality of socket lighting sub-elements, said light bulb having a third terminal disposed between said first and second terminals of said light bulb and said socket lighting element having a third terminal disposed between said first and second lighting element terminals, said third terminal of said light bulb coupled to said third terminal of said socket lighting element when said bulb is seated in said socket, said third terminal of said bulb electrically coupled at a point between two of said plurality of bulb lighting elements within said bulb, said third terminal of said socket lighting element coupled at a point between two of said plurality of said socket lighting sub-elements, said sensor of said socket lighting element is a bias voltage applied across said third terminal of said socket lighting element and one of said first and second terminals of said socket lighting element, said sensor allowing current to pass through at least one of said sub-elements of said socket lighting element disposed between said third terminal and said one of said first and second terminals of said socket lighting element when said bias voltage is exceeded.

8. A light socket collar for coupling to a light socket, said light socket providing power to a light bulb, said light socket having first and second terminals coupled to a respective first and second light string leads, said first and second light string leads coupled to an electrical power source to provide current to said socket through said first and second light string leads, said first and second terminals coupled to respective first and second leads of said bulb when said bulb is seated in said light socket said electrical power source causing current to flow through said bulb between said first and second socket terminals and said respective first and second light string leads when said bulb is seated in said socket, said collar comprising:

a housing having a socket connection end, said housing coupled to a first and second collar terminals, said first and second collar terminals extending outside said housing at said socket connection end, said housing including a collar lighting element coupled to said housing and having a first and second collar lighting element terminals, said first and second collar lighting element terminals coupled respectively to said first and second collar terminals and making electrical connection therewith for providing current to said collar lighting element, said collar lighting element having a sensor for sensing a voltage applied across said first and second collar terminals, said sensor allowing current to pass through said collar lighting element when said sensor detects a voltage change across said first and second collar terminals, said collar lighting element being illuminated upon said detected voltage change.

9. The light socket collar of claim 8 wherein said sensor is a bias voltage applied across said collar lighting element terminals, said sensor allowing current to pass through said collar lighting element when said bias voltage across said first and second terminals of said collar lighting element is exceeded.

10. The light socket collar of claim 9 wherein said light bulb contains an LED and said collar lighting element includes two LEDs connected in series, one each of the two ends of said series-connected LEDs comprising one each of said first and second collar lighting element terminals, said bias voltage of said two, series-connected LEDs in said collar lighting element being greater than a bias voltage of said LED within said bulb.

11. The light socket collar of claim 9 wherein said light bulb is an incandescent bulb and said collar lighting element comprises two LEDs and a resistor all connected in series, one each of the two ends of s a id series-connected LEDs and resistor comprising one each of said first and second collar lighting element terminals, said bias voltage of said two, series-connected LEDs and said resistor in said lighting element being greater than a bias voltage of said bulb.

12. The light socket of claim 9 wherein said light bulb contains two cross-coupled LEDs such that one of said LEDs within said bulb is illuminated when the current through said light bulb flows in one direction and the other of said LEDs within said bulb is illuminated when the current through said light bulb flows in the other direction, said socket lighting element further comprising at least two sub-elements, said socket sub-elements each including two cross-coupled LEDs, such that one of said LEDs within said sub-element is illuminated when the current through said sub-element is in said one direction.

13. The light socket collar of claim 8 wherein said collar lighting element is one of an LED, an electroluminescent element, or an organically deposited lighting structure.

14. A light socket for providing power to a light bulb, said bulb having two bulb leads, said light socket having two terminals coupled to two light string leads, said light string leads coupled to an electrical power source to provide current to said socket through said two light string leads, said terminals coupled to said two bulb leads when said bulb is seated in said light socket, said said electrical power source causing current to through said light string leads, said socket terminals and said bulb leads so as to illuminate said bulb when said bulb is seated in said socket, said socket comprising:

a socket lighting element disposed on said socket, said lighting element having an activation terminal; and a sensor coupled to said light socket and said light socket terminals for sensing a voltage applied across said light socket terminals, said sensor coupled to said activation terminal, said sensor sending an activation signal to said activation terminal when said sensor detects a change in said voltage applied across said light socket terminals, said activation signal causing said socket lighting element to illuminate.

15. The light socket of claim 14 wherein said lighting element is a fluorescent or electroluminescent light.

* * * * *